US008404176B2

(12) United States Patent
Kim et al.

(10) Patent No.: US 8,404,176 B2
(45) **Date of Patent: *Mar. 26, 2013**

(54) HYBRID METHOD MANUFACTURING APPARATUS FOR TORSION BEAM

(75) Inventors: Byungju Kim, Daegu (KR); Sangmyung Kim, Busan (KR); Sanggil Jang, Ulsan (KR); Cheolhwan Cho, Daegu (KR)

(73) Assignee: Donghee Industrial Co., Ltd., Ulsan (KR)

( * ) Notice: Subject to any disclaimer, the term of this patent is extended or adjusted under 35 U.S.C. 154(b) by 339 days.

This patent is subject to a terminal disclaimer.

(21) Appl. No.: 12/850,017

(22) Filed: Aug. 4, 2010

(65) Prior Publication Data

US 2011/0037207 A1 Feb. 17, 2011

(30) Foreign Application Priority Data

Aug. 11, 2009 (KR) ..... 10-2009-0073735

(51) Int. Cl.
*C21D 8/00* (2006.01)

(52) U.S. Cl. ..... 266/115; 266/104; 148/653

(58) Field of Classification Search ..... 266/104, 266/115; 148/653

See application file for complete search history.

(56) References Cited

U.S. PATENT DOCUMENTS

| | | | | |
|---|---|---|---|---|
| 5,487,795 | A * | 1/1996 | Kim et al. | 148/520 |
| 5,507,518 | A * | 4/1996 | Nakahara et al. | 280/124.166 |
| 5,653,937 | A * | 8/1997 | Kim et al. | 266/104 |
| 6,487,886 | B2 | 12/2002 | Ueno et al. | |
| 2011/0036470 | A1* | 2/2011 | Kim et al. | 148/653 |
| 2011/0037207 | A1* | 2/2011 | Kim et al. | 266/115 |

FOREIGN PATENT DOCUMENTS

| | | | |
|---|---|---|---|
| EP | 0788903 | A1 | 8/1997 |
| JP | 2001-321846 | A | 11/2001 |

* cited by examiner

*Primary Examiner* — Scott Kastler
(74) *Attorney, Agent, or Firm* — LRK Patent Law Firm

(57) ABSTRACT

A hybrid method manufacturing apparatus for a torsion beam according to an exemplary embodiment of the present invention includes a pair of side punch molds where a semi-finished product material heated to approximately 880 to 800° C. is molded and a press mold where a cooling water circulation line decreasing the temperature of the processed finished product to approximately 750 to 450° C. while the semi-finished product material is molded to a processed finished product is installed, an advantage of high-temperature molding having high dimensional accuracy is maintained at the time of manufacturing the torsion beam and additional heat treatment such as tempering is selectively performed only when additional heat treatment such as tempering increases toughness because only a martensite structure is not formed in quenching treatment.

7 Claims, 5 Drawing Sheets

HYBRID METHOD MANUFACTURING APPARATUS FOR TORSION BEAM

BACKGROUND OF THE INVENTION

1. Field of the Invention

The present invention relates to a manufacturing apparatus of a torsion beam of a suspension apparatus, and more particularly, to a hybrid method manufacturing apparatus for a torsion beam which can improve dimensional accuracy by high-temperature molding and in which additional heat treatment such as tempering is selectively performed only when it is necessary to increase toughness because only a martensite structure is not formed in quenching treatment.

2. Description of the Related Art

In general, concentration of a vehicle's load and inclination of a vehicle which are generated by turning the vehicle are adjusted by roll control and for the purpose of the roll control, a torsion bar or a torsion beam is applied to a suspension apparatus.

Both ends of the torsion bar or the torsion beam are twisted to control roll when a wheel center phase difference between both wheels occurs due to turning. Therefore, the torsion bar or the torsion beam should have torsional rigidity.

The torsional rigidity is easily applied to the torsion bar, while an additional reinforcing member should be attached over both ends of the torsion beam in order to apply the torsional rigidity to the torsion beam.

Therefore, it is very important to adopt a molding method of applying excellent torsional rigidity to the torsion beam itself in the case of the torsion beam. For example, a heat treatment process such as tempering or quenching is being performed in order to increase tensile strength and improve rigidity at a molding process of the torsion beam.

The heat treatment method is divided into an indirect cooling method in which a product is heated thereafter, cooled and molded in a mold and a direct cooling method in which a product is molded at room temperature and thereafter, heated and quickly cooled with water.

A tubular coupled torsion beam axle (CTBA) generally adopted in a rear suspension apparatus of a medium-sized passenger car requires tensile strength of approximately 140 $kg/mm^2$.

Since the tensile strength of the tubular CTBA to which the indirect cooling method is applied is in the range of 100 $kg/mm^2$ to 140 $kg/mm^2$, reliability is not high, while since the tensile strength of the tubular CTBA to which the direct cooling method is applied is 140 $kg/mm^2$, the reliability is high.

In general, since the quenching treatment used in the direct cooling method is a method in which a material is heated at high temperature and thereafter, the heated material is quickly cooled with water for a short time, a possibility that a cross section of the material will be changed due to quick cooling is high and a risk that even the manufactured product will not meet a designed standard increases.

Therefore, in the direct cooling method, an additional jig capable of preventing the change of the cross section of the material caused by heat treatment should be used, which is inconvenient for a user.

Further, since an internal structure quickly cooled in the quenching treatment is transformed to the martensite structure which is vulnerable to a fatigue crack, another heat treatment process such as tempering for applying toughness after the quenching treatment needs to be additionally performed. As a result, these dual treatments cannot be help causing an increase in the number of processes, a decrease of productivity, and an increase of manufacturing cost.

SUMMARY OF THE INVENTION

The present invention has been made in an effort to provide a hybrid method manufacturing apparatus for a torsion beam capable of implementing an advantage of high-temperature molding having high dimensional accuracy by high-temperature molding in a mold and forming a Ferrite structure together at a predetermined ratio by preventing quick cooling which is quickly performed in quenching treatment by lowering temperature through an indirect cooling method during a high-temperature molding process.

An exemplary embodiment of the present invention provides a hybrid method manufacturing apparatus for a torsion beam that includes: a room-temperature molding apparatus making a circular hollow raw material to a pre-forming material which is 50 to 80% of an actual torsion beam shape through cold expansion molding at room temperature; a heating apparatus heating the pre-forming material up to A3 transformation point temperature by using a heating furnace and making the heated pre-forming material to a semi-finished product material acquired by austeniting an internal structure of the heated pre-forming material; a remolding apparatus in which the semi-finished material is set by a molding mold, the semi-finished product material is molded to a process finished product of a 100% actual torsion beam shape by a pair of side punch molds, and the temperature of the processed finished product is decreased by non-contact cooling with cooling water which flows in cooling water circulation lines arranged to surround an entire shape of the semi-finished product material; a heat treatment apparatus applying heat treatment to the processed finished product; and a post processing apparatus manufacturing a final finished product by post-processing the heat-treated processed finished product.

The hybrid method manufacturing apparatus for a torsion beam further includes a loading apparatus transporting the pre-forming material between the room-temperature molding apparatus and the heating apparatus.

The cooling water circulation line includes horizontal lines that are arranged between an inlet and an outlet of cooling water at regular intervals and cross the width of the molding mold and cooling lines that are connected with the horizontal lines to surround the entire length of the torsion beam.

The cooling lines are uniformly arranged depending on a change of a cross-sectional shape of the torsion beam.

The heat treatment apparatus may be a first heat treatment apparatus for quenching treatment in which the processed finished product is directly cooled by water.

The heat treatment apparatus may include a first heat treatment apparatus for the quenching treatment in which the processed finished product is directly cooled by water and a secondary heat treatment apparatus for a tempering treatment in which the quenched processed finished product is heated and thereafter, air-cooled.

The post processing apparatus includes a shot blast apparatus for shot blast surface treatment, a cutting apparatus for final finishing shaping of the torsion beam, and an unloading apparatus for loading the final torsion beam.

According to the exemplary embodiment of the present invention, since a Ferrite structure is together formed at a predetermined ratio by preventing quick cooling which is quickly performed in quenching treatment by lowering temperature through an indirect cooling method during a high-temperature molding process, tempering treatment is required only when it increases toughness.

DETAILED DESCRIPTION OF THE EMBODIMENTS

Figure 1:
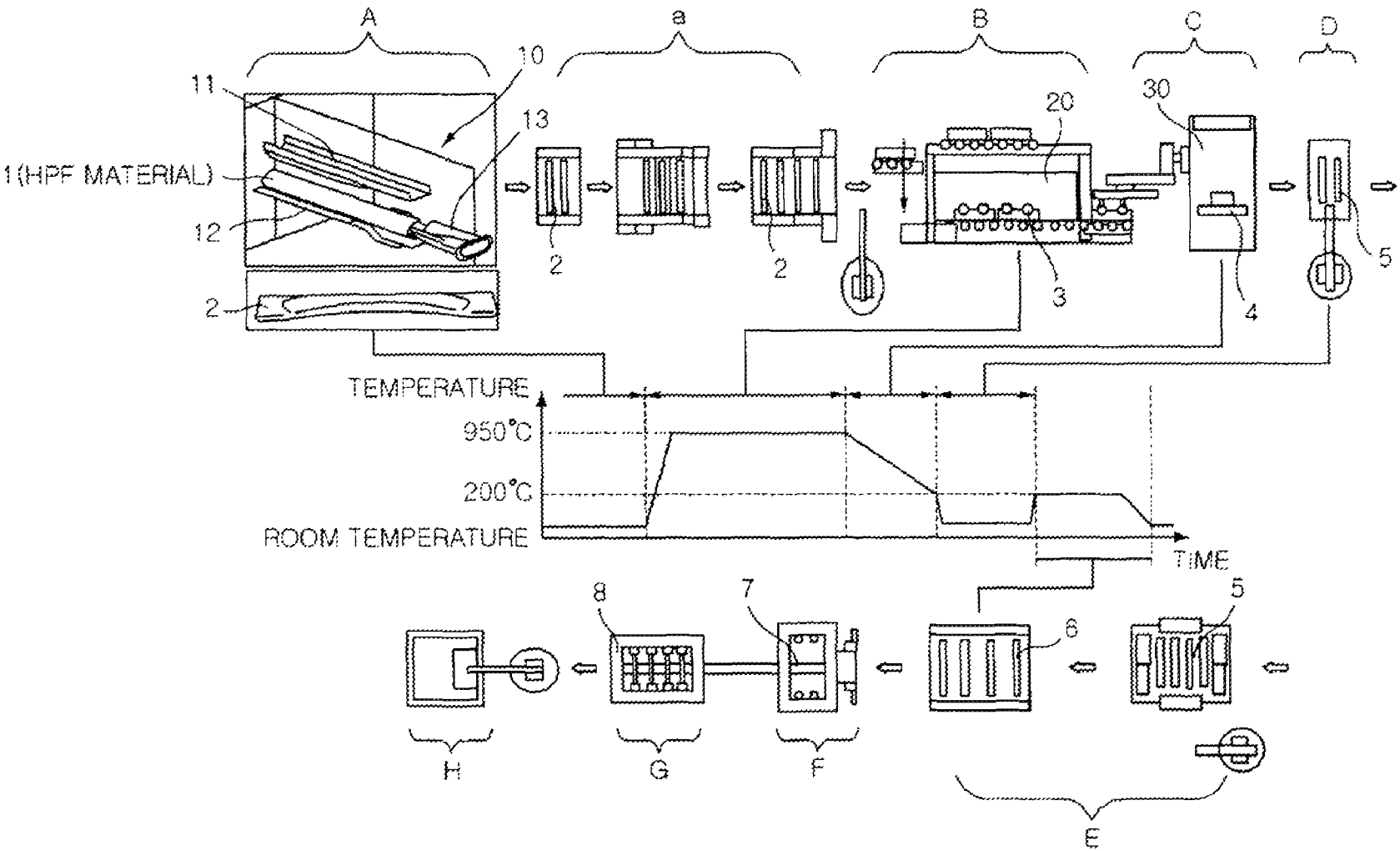
FIG. 1 is an overall configuration diagram of a hybrid method manufacturing apparatus for a torsion beam according to an exemplary embodiment of the present invention.

Referring to FIG. 1, a hybrid method manufacturing apparatus for a torsion beam is constituted by processing apparatuses for each step for making an inputted material in a shape of a tubular coupled torsion beam axle (CTBA) through molding, increase tensile rigidity of a torsion beam manufacturing through heat treatment to approximately 140 kg/mm$^2$, and manufacturing a product completed by post-processing the torsion beam.

The apparatus for each step is constituted by a room-temperature molding apparatus A, a loading apparatus a, a heating apparatus B, a remolding apparatus C, a heat treatment apparatus, and post processing apparatuses.

The room-temperature molding apparatus A includes a cold molding mold 10 for cold expansion molding (cold molding) for making a circular hollow raw material 1 to a pre-forming material 2 at room temperature.

The cold molding mold 10 includes a die 12 on which the raw material 1 is laid, a side punch 13 catching and fixing the side of the raw material 1, and a punch 11 for molding the raw material 1 to the pre-forming material 2.

Various materials are adopted as the raw material 1, but in the exemplary embodiment, a heat-treated material containing Boron is used and preferably has tensile strength of approximately 40 to 60 kg/mm$^2$.

When the raw material 1 is laid on the die 12 and the side is fixed by using the side punch 13, the punch 11 molds the raw material 1 to the pre-forming material 2 which is approximately 50 to 80% of an actual torsion beam shape.

In the loading apparatus a, the pre-forming material 2 is loaded to be washed or dried or processes for visually inspecting whether or not the pre-forming material 2 is cracked or broken are performed. Equipments for the processes are installed in the loading apparatus a.

For example, the loading apparatus a includes a roller conveyor for loading and transporting the pre-forming material 2 or equipments such as a robot arm capable of picking up the pre-forming material 2.

The heating apparatus B includes a heating furnace 20 that heats the pre-forming material 2 to make the pre-forming material 2 to a semi-finished product material 3. In the heating furnace 20, the pre-forming material 2 is loaded and heated for approximately 5 to 10 minutes to be made to the semi-finished product material 3 of which the temperature increases to approximately 950 to 910° C.

As described above, 950 to 910° C. which is the heating temperature of the pre-forming material 2 is A3 transformation point temperature at which an internal structure is austenited.

In the remolding apparatus C, the heated semi-finished product material 3 is molded to the processed finished product 4 and a press mold 30 where cooling water is circulated so as to indirectly cool the semi-finished product material 3 at the time of molding the semi-finished product material 3 is provided.

Figure 2:
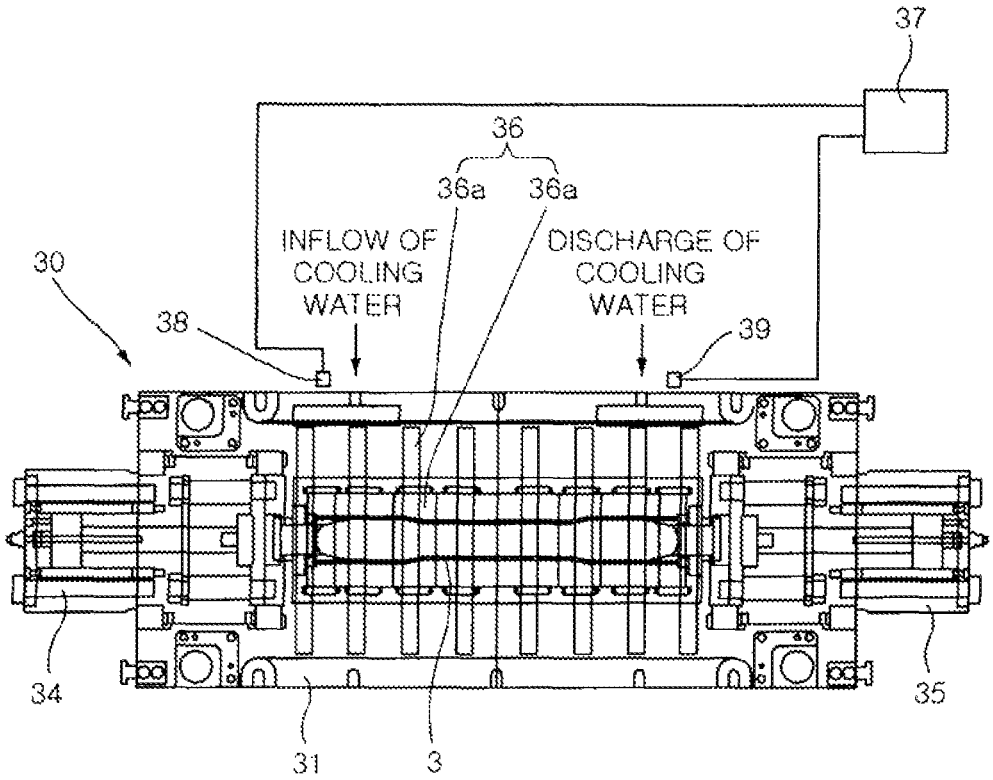
FIG. 2 is a configuration of a press mold with a cooling water circulation structure.
Figure 2:
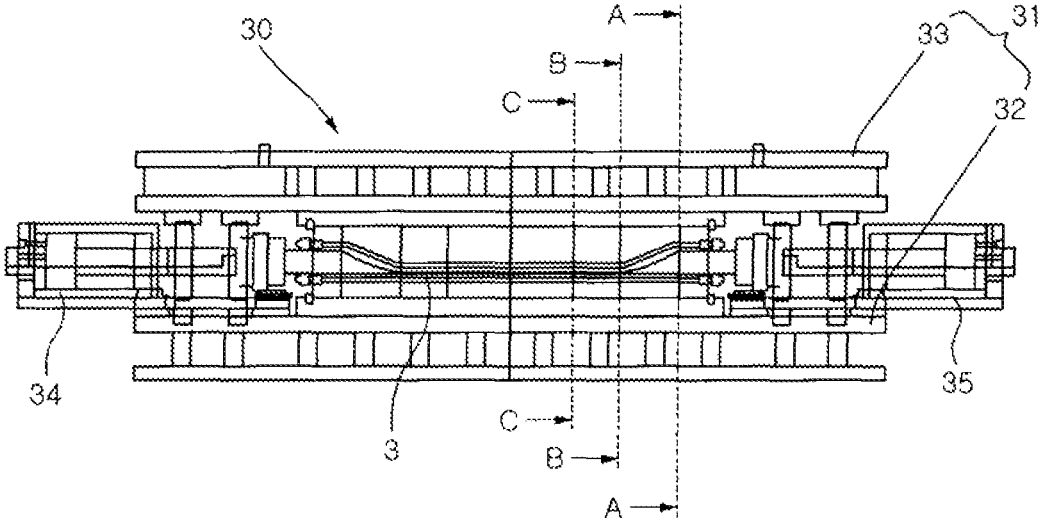

FIG. 2 illustrates the remolding apparatus C and as shown in the figure, the press mold 30 with a cooling water circulation structure is provided in the remolding apparatus C.

The press mold 30 includes equipments required to mold the semi-finished product material 3 like a general press mold and in addition, further includes a molding mold 31 where the semi-finished product material 3 heated at high temperature is loaded and remolded, a cooling water circulation line 36 that allows the cooling water to flows around the semi-finished product material 3, and a control panel 37 controlling the circulation of the cooling water.

The molding mold 31 includes lower and upper dies 32 and 33 where the semi-finished product material 3 heated to approximately 950 to 910° C. is loaded and a pair of side punch molds 34 and 35 that are provided at both ends of the lower and upper ides 32 and 33 and molds both ends of the semi-finished product material 3 to make it to the processed finished product 4.

When the semi-finished product material 3 is transported to and set on the lower and upper dies 32 and 33, the pair of side punch molds 34 and 35 mold the semi-finished product material 3 to mold the processed finished product 4 having a 100% completed torsion beam shape.

While the semi-finished material 3 is moved to and set on the press mold 30, the temperature of approximately 950 to 910° C. at the initial stage is decreased to temperature of approximately 880 to 800° C. by air cooling.

As shown in FIG. 2, the cooling water circulation line 36 includes horizontal lines **36*a* that are arranged between an inlet and an outlet of cooling water at regular intervals and cross the width of the upper die 33 and cooling lines 36*b* that are connected with the horizontal lines 36*a*, and of which a portion is installed in the lower die 32 and the other portion is installed in the upper die 33** to surround the entire length of the torsion beam.

Figure 3:
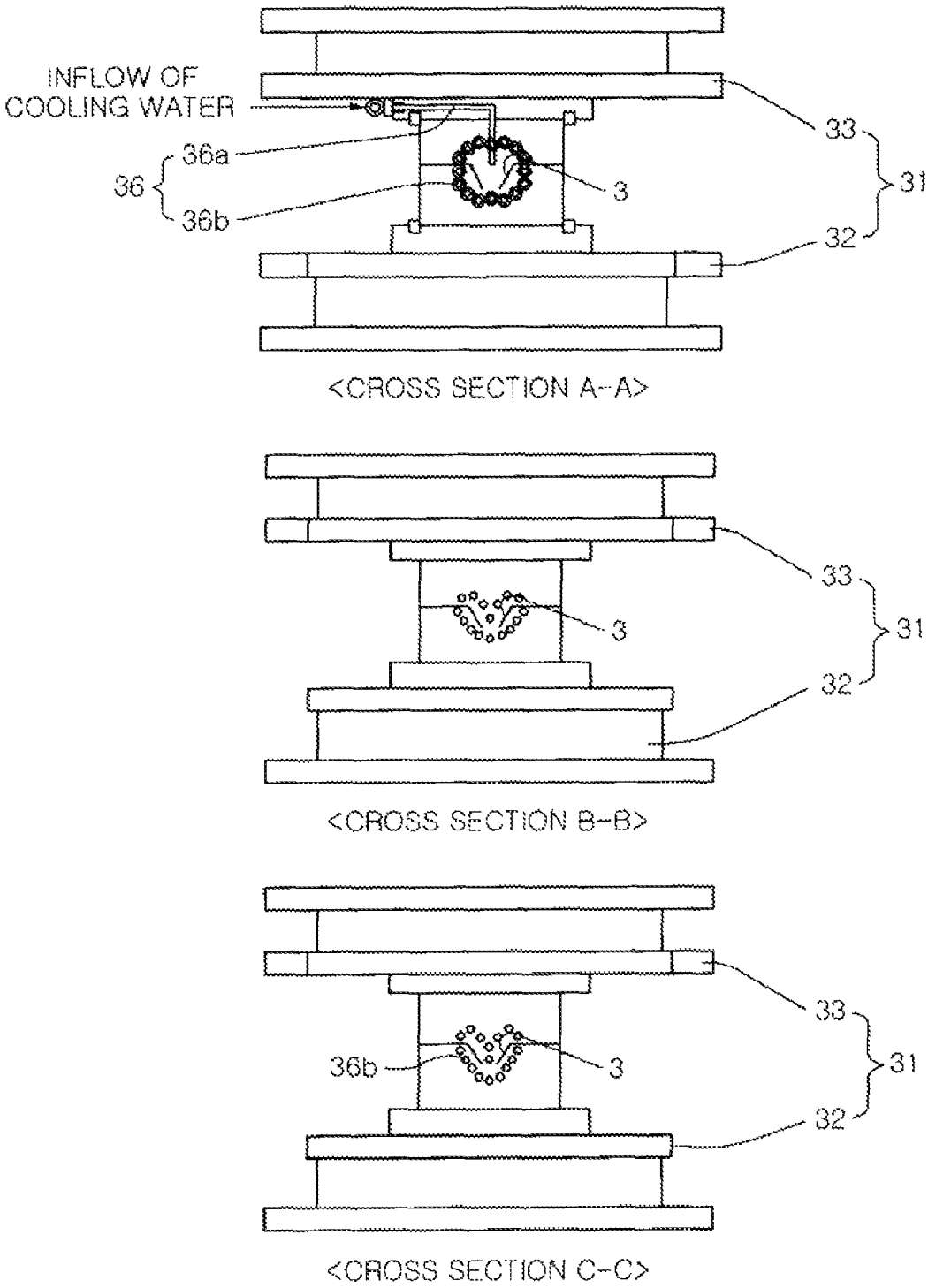
FIG. 3 is a cross-sectional view of sections A-A, B-B, and C-C of FIG. 2.

In FIG. 3, an arrangement state of the cooling lines **36*b* depending on a change of a cross-sectional shape of the torsion beam is shown. As shown in the figure, the cooling lines 36*b*** are arranged substantially in a circular shape on an A-A cross section, arranged in a heart shape on a B-B cross section, and arranged in a distorted heart shape on a C-C cross section.

Figure 4:
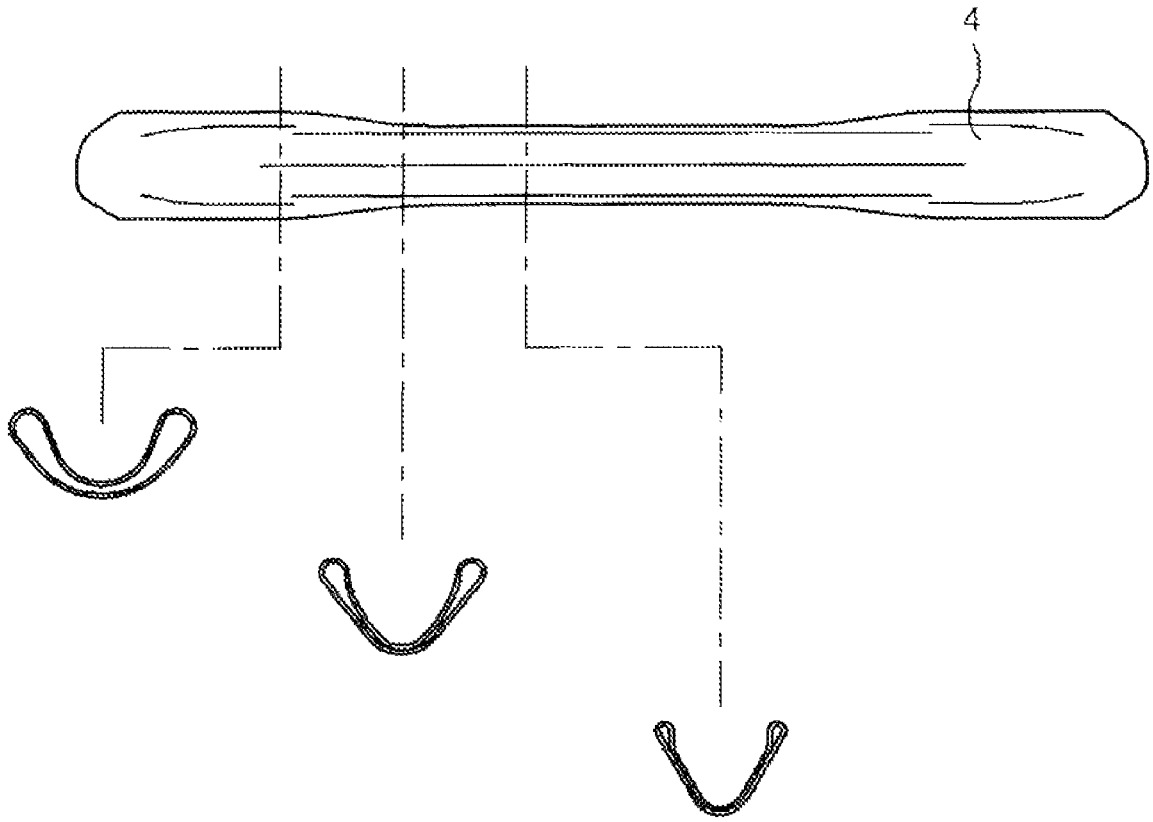
FIG. 4 is a configuration diagram of a tubular coupled torsion beam axle (CTBA) manufactured according to an exemplary embodiment of the present invention.
Figure 5:
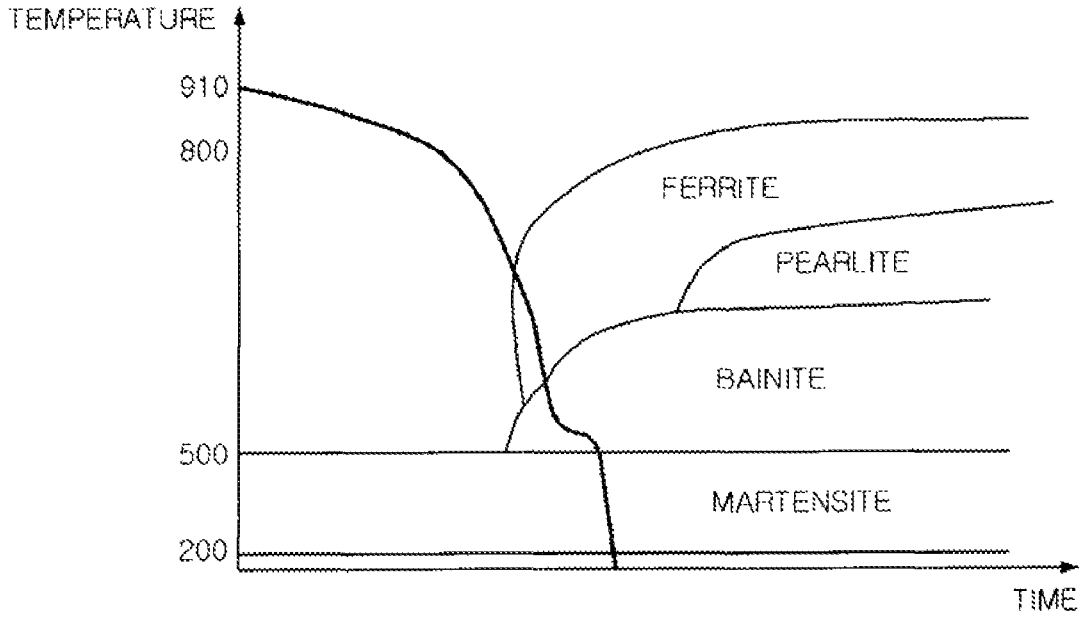
FIG. 5 is a diagram illustrating an internal structure of a torsion beam according to an exemplary embodiment of the present invention.

A torsion beam of which a cross-sectional shape is changed in the order of A-A, B-B, and C-C in sequence is a general tubular torsion beam shown in FIG. 4. The change of an arrangement pattern of the cooling lines **36*b*** may prevent a difference in cooling capacity for each portion which may occur in the tubular torsion beam.

In the case of the torsion beam which is uniformly cooled on the whole, a volume ratio of martensite is increased on the cross section B-B, as a result, rigidity may be reinforced. The rigidity reinforcement causes durability for a load applied from a trailing arm while the torsion beam is joined to the trailing arm to be increased The control panel 37 generates control signals such as a driving signal and a stop signal, and an interrupt signal and includes temperature sensors 38 and 39 and an electric circuit in order to control the temperature of the cooling water.

As shown in FIG. 2, the temperature sensors 38 and 39 are installed an inlet part through which the cooling water is introduced into the cooling water circulation line 36 and an outlet part through which the cooling water is discharged from the cooling water circulation line 36, respectively.

The control panel 37 controls a circulation cycle of the cooling water so as to decrease the temperature of a molding-completed processed finished product 4 to temperature of approximately 750 to 450° C. while the semi-finished product material 3 having temperature of approximately 880 to 800° C. is molded to the processed finished product 4.

During such a process, the circulation cycle of the cooling water is set to approximately 2 to 15 sec., and the temperature at an inlet of the cooling water is maintained be approximately 5 to 30° C. and the temperature at an outlet of the cooling water is maintained to be approximately 50° C. or lower.

As described above, the processed finished product 4 that is molded to the 100% torsion beam shape and molded at temperature decreased to approximately 750 to 450° C. is heat-treated at least once and the heat treatment of the processed finished product 4 is performed in additional heat treatment apparatus.

As shown in FIG. 1, the heat treatment apparatus includes a first heat treatment processing apparatus D for quenching treatment and a secondary heat treatment apparatus E for tempering treatment subsequent to the first heat treatment apparatus D.

The first heat treatment apparatus D includes an equipment having space having a size as large as the processed finished product 4 having temperature of approximately 750 to 450° C. is set and fully dipped in water to be quenched.

The first heat treatment apparatus D may use an additional cooling equipment filled with water, but in the exemplary embodiment, a bath capable of filling water in the press mold 30 that makes the semi-finished product material 3 to the processed finished product 4 may be installed.

The quenched processed finished product 4 is called a first heat-treated finished product 5.

In the exemplary embodiment, since the processed finished product 4 is quenched while the temperature of the processed finished product 4 of approximately 880 to 800° C. in the initial stage is decreased to approximately 750 to 450° C. which is comparatively lower than the initial temperature, it is possible to prevent only the martensite structure from being formed due to quick cooling in the quenching treatment at comparatively high temperature of approximately 880 to 800° C.

In FIG. 6, the internal structure distribution of the first heat-treated finished product 5 acquired by quenching the processed finished product 4 is shown.

As shown in the figure, the internal structure of the first heat-treated finished product 5 includes a martensite structure having most structural ratios, a bainite structure having a structural ratio of approximately 1% or less, and a ferrite structure having a structural ratio of approximately 5% or less.

As described above, when the ferrite structure is distributed together with the martensite structure and the bainite structure, toughness is applied by only the quenching treatment so as to improve fatigue characteristics.

Accordingly, a known equipment for the tempering treatment for applying toughness is not needed, as a result, it is possible to shorten a working process.

The secondary heat treatment apparatus E for the tempering treatment includes an equipment for heating the first heat-treated finished product 5 at temperature of 200 to 500° C. for 3 to 15 minutes and an equipment for air-cooling (slowly cooling) the first heat-treated finished product 5.

The first heat-treated finished product 5 which is tempered by the secondary heat treatment apparatus E is called a secondary heat-treated finished product 6.

In the exemplary embodiment, since the secondary heat-treated finished product 6 is different from the first heat-treated finished product 5 in only a ratio of the ferrite structure and the secondary heat-treated finished product 6 is slightly different from the first heat-treated finished product 5 in a physical property, the tempering treatment which is the secondary heat treatment is not performed or although the tempering treatment is performed, the tempering treatment is implemented only when it increases toughness.

Post processing for making the first heat-treated finished product 5 or the secondary heat-treated finished product 6 to a final finished product 8 is performed with respect to the first heat-treated finished product 5 or the secondary heat-treated finished product 6. In FIG. 1, a post processing apparatus for post processing is shown.

As shown in the figure, the post processing apparatus includes a shot blast apparatus F, a cutting apparatus G, and an unloading apparatus H. The first heat-treated finished product 5 or the secondary heat-treated finished product 6 that passes through the apparatuses is manufactured to the final finished product 8.

In the shot blast apparatus F, the first heat-treated finished product 5 or the secondary heat-treated finished product 6 is surface-treated by a shot blast method to be made to a post processing finished apparatus 7 and in the cutting apparatus G, a final finished product 8 which is the tubular torsion beam is made by laser cutting.

The unloading apparatus H as an equipment for air-cooling the final finished product 8 at room temperature is a place where the final finished product 8 is loaded.

What is claimed is:

1. A hybrid manufacturing apparatus for a torsion beam, comprising:

a room-temperature molding apparatus making a circular hollow raw material to a pre-forming material which is 50 to 80% of an actual torsion beam shape through cold expansion molding at room temperature;

a heating apparatus heating the pre-forming material up to A3 transformation point temperature by using a heating furnace and making the heated pre-forming material to a semi-finished product material acquired by austeniting an internal structure of the heated pre-forming material;

a remolding apparatus in which the semi-finished material is set by a molding mold, the semi-finished product material is molded to a process finished product of a 100% actual torsion beam shape by a pair of side punch molds, and the temperature of the processed finished product is decreased by non-contact cooling with cooling water which flows in cooling water circulation lines arranged to surround an entire shape of the semi-finished product material;

a heat treatment apparatus applying heat treatment to the processed finished product; and a post processing apparatus manufacturing a final finished product by post-processing the heat-treated processed finished product.

2. The hybrid manufacturing apparatus for a torsion beam according to claim 1, further comprising a loading apparatus transporting the pre-forming material between the room-temperature molding apparatus and the heating apparatus.

3. The hybrid manufacturing apparatus for a torsion beam according to claim 1, wherein the cooling water circulation line includes horizontal lines that are arranged between an inlet and an outlet of cooling water at regular intervals and cross the width of the molding mold and cooling lines that are connected with the horizontal lines to surround the entire length of the torsion beam.

4. The hybrid manufacturing apparatus for a torsion beam according to claim 3, wherein the cooling lines are uniformly arranged around the torsion beam to have a shape corresponding to a cross-sectional shape of the torsion beam which is changed along the length of the torsion beam.

5. The hybrid manufacturing apparatus for a torsion beam according to claim 1, wherein the heat treatment apparatus is a first heat treatment apparatus for quenching treatment in which the processed finished product is directly cooled by water.

6. The hybrid manufacturing apparatus for a torsion beam according to claim 1, wherein the heat treatment apparatus includes the first heat treatment apparatus for the quenching treatment in which the processed finished product is directly cooled by water and a secondary heat treatment apparatus for a tempering treatment in which the quenched processed finished product is heated and thereafter, air-cooled.

7. The hybrid manufacturing apparatus for a torsion beam according to claim 1, wherein the post processing apparatus includes a shot blast apparatus for shot blast surface treatment, a cutting apparatus for final finishing shaping of the torsion beam, and an unloading apparatus for loading the final torsion beam.

* * * * *